United States Patent [19]

Simon et al.

[11] Patent Number: 4,840,652

[45] Date of Patent: Jun. 20, 1989

[54] METHOD OF GENERATING AND USING COLD, AND DEVICE FOR IMPLEMENTING SUCH METHOD

[75] Inventors: Laszlo Simon, Satigny; Jean Pfau, Collonge-Bellerive, both of Switzerland

[73] Assignee: Coldeco S.A., Carouge, Switzerland

[21] Appl. No.: 110,723

[22] PCT Filed: Jan. 16, 1987

[86] PCT No.: PCT/CH87/00008

§ 371 Date: Sep. 17, 1987

§ 102(e) Date: Sep. 17, 1987

[87] PCT Pub. No.: WO87/04510

PCT Pub. Date: Jul. 30, 1987

[30] Foreign Application Priority Data

Jan. 18, 1986 [CH] Switzerland ..... 00178/86
Jan. 18, 1986 [CH] Switzerland ..... 00179/86
Jan. 18, 1986 [CH] Switzerland ..... 00181/86

[51] Int. Cl.[4] ..... B01D 9/04; C02F 1/22

[52] U.S. Cl. ..... 62/534; 62/123; 62/434

[58] Field of Search ..... 62/123, 532, 533, 534, 62/434

[56] References Cited

U.S. PATENT DOCUMENTS 3,587,240 6/1971 Martindale et al. ..... 62/534
4,452,621 6/1984 Fowles et al. ..... 62/534
4,596,120 6/1986 Knodel et al. ..... 62/534

FOREIGN PATENT DOCUMENTS 932215 7/1963 United Kingdom .

*Primary Examiner*—Ronald C. Capossela
*Attorney, Agent, or Firm*—Frost & Jacobs

[57] ABSTRACT

A method and apparatus for generating, by siphon effect, in a housing containing a cold-accumulating and freezable liquid, a current of liquid in a closed hydraulic circuit, the current of liquid comprising at least one ascending current which is located over means for injecting a refrigerating fluid and which contains bubbles of atomized refrigerating fluid, and at least one descending current free of refrigerating fluid in the gaseous phase.

25 Claims, 3 Drawing Sheets

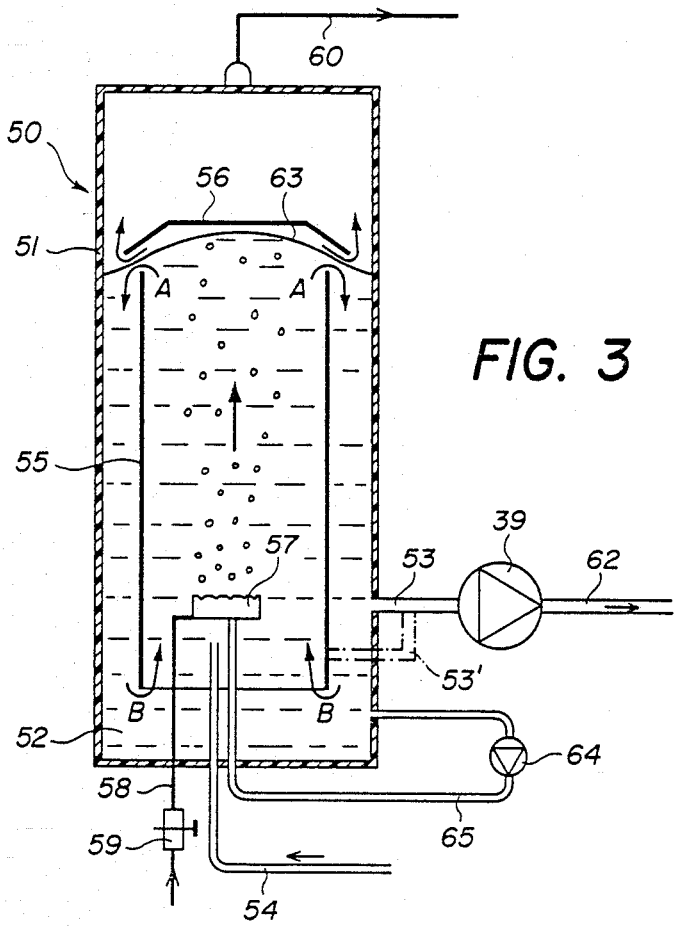
FIG. 3
FIG. 4
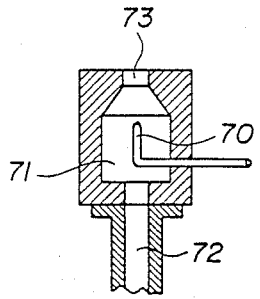

METHOD OF GENERATING AND USING COLD, AND DEVICE FOR IMPLEMENTING SUCH METHOD

BACKGROUND OF THE INVENTION

The present invention relates to a method of generating cold and using it either directly or indirectly after transient storage and restitution, wherein cooling and/or partial freezing of a cold-accumulating and cooling liquid partially filling a cooling cell is effected by injecting a refrigerant at least partly in the liquid state into a mass of said cold-accumulating and cooling liquid, contained in said cooling cell, and vaporizing this refrigerant directly in this liquid, and by collecting the refrigerant in the gaseous state at the upper part of this cell, above a free surface of the cold-accumulating and cooling liquid, and wherein the cold-accumulating and cooling liquid is withdrawn from this cell, and is conveyed in a cold-utilization circuit and/or to at least one cold-storage cell, then is reintroduced into said cooling cell.

It also relates to a device for implementing this method, including at least one cooling cell containing a cold-accumulating and cooling liquid, partially filling this cell, means for injecting and vaporizing a refrigerant at least partly in the liquid state into a mass of cold-accumulating and cooling liquid, means for collecting the refrigerant in the gaseous state at the upper part of this cell, above a free surface of the cold-accumulating and cooling liquid, and means for withdrawing cold-accumulating and cooling liquid from this cell and for conveying it in a circuit for cold-utilization and/or to at least one cold-storage cell, and then reintroducing it into the cooling cell.

In recent years, various methods of generating and accumulating cold have been developed which seek to solve the problem arising from the fact that the diagram of utilization of cold in an installation is generally irregular and often passes through a transient maximum.

In a particularly advantageous method of generating and accumulating cold described in Swiss Pat. No. 628,417 filed on 6.01.1978, crystals of a frozen cold-accumulating and cooling liquid are produced - this liquid generally consisting of water or an aqueous solution - in a mass of this liquid contained in a crystallizing cell and vaporizing a refrigerant injected into this liquid mass, while collecting and aspirating this refrigerant in the gaseous state at the top of this crystallizing cell above the free surface of this liquid mass. The mixture of cold-accumulating and cooling liquid and crystals of this frozen liquid thus formed is brought into a cold-storage cell where these crystals are accumulated in the form of a solid mass impregnated with liquid.

A first problem encountered with this method is that the microscopic crystals produced in the crystallizing cell, the specific mass of which is less than that of the cold-accumulating and cooling liquid, tend to be agglomerated and accumulated by decantation in the vicinity of the free surface of the accumulating liquid. This leads to the risk of a plug of agglomerated crystals being formed in the vicinity of the free surface of the accumulating liquid contained in the crystallizing cell. This plug rapidly fills the space surmounting the injector, which interferes with the vaporization of the refrigerant and/or necessitates its interruption.

A second problem encountered with this method arises from the difficulty of transporting said crystals and/or accumulating them in the form of a porous, homogeneous and compact mass, because these crystals form with the accumulating liquid withdrawn from the cell a heterogeneous mixture, of partly solid consistency, of crystal agglomerates of large dimensions which may go up to several centimeters, these agglomerates being produced in the bulk of cold-accumulating and cooling liquid and/or detached from the above-mentioned plug.

A third problem encountered with this method is that a part of the gaseous refrigerant injected and/or produced by vaporization in the crystallizing cell risks being carried along with the cold-accumulating and cooling liquid, containing said crystals, withdrawn from the cell to be conveyed in a circuit for exchanging cold, directly or after its passage in a cold-storage cell. This results in multiple drawbacks, one of which is the necessity of frequently purging the different elements of the circuit traversed by the conveyed mixture.

A fourth problem encountered with this method is that the known systems for implementing it are confronted with problems of icing of the injector for the refrigerant. This icing is observed on the exterior of the injector which is immersed in the mass of cold-accumulating and cooling liquid, but also partly within the body of the injector when the refrigerant contains even a minute proportion of this cold-accumulating and cooling liquid. Various mechanical or thermal means are presently used for periodically deicing the injector. However, these current means lower the thermodynamic efficiency of the installation and are costly and of low reliability. In addition, they necessitate periodic interruption of the cold-production cycle, which decreases the mean refrigerating capacity of the installation.

SUMMARY OF THE INVENTION

The present invention has the object of providing a method and a device for its implementation which allow all of the drawbacks mentioned above to be palliated.

It has as a first object to maintain in the entire mass of cold-accumulating and cooling liquid in which said crystals are generated a gel or a homogeneous suspension of crystals, of fluid consistency by preventing the formation of plugs and/or crystal agglomerates of solid consistency.

It has as a second object to ensure, in a cooling cell containing a cold-accumulating and cooling liquid which is cooled and/or partially frozen by direct vaporization of a refrigerant in the bulk of this liquid, a good separation of the gaseous refrigerant from said mass of liquid in the vicinity of the free surface of this liquid mass.

It also has the object of enabling said gel or said suspension of crystals to be effectively and economically conveyed, without employing circulating pumps, to a cell for accumulating these crystals with a view to storage of cold, while this cell may but need not be combined with the crystallizing cell.

It finally has the object of suppressing the risk of icing of the refrigerant injector or injectors and of avoiding the constraint of the utilizer having to regularly stop the installation to undertake such deicing.

These objects are met by the method according to the invention, which is characterized in that a stream of liquid in closed hydraulic circuit is generated in said cell, this stream including at least one ascending stream of cold-accumulating and cooling liquid, located substantially above a zone of injection of refrigerant at least partly in the liquid state, located on a portion of the horizontal section of the cell, and at least one descending stream formed essentially of cold-accumulating and cooling liquid free of gaseous refrigerant, this stream in closed hydraulic circuit being produced by a siphon effect and induced by the reduction of the mean density of the mixture of liquid and bubbles of vaporized refrigerant above said injection zone.

The injection rate of said refrigerant is advantageously adjusted in such a manner that its vaporization generates a gel or a fluid and homogeneous suspension of crystals of cold-accumulating and cooling liquid frozen in the bulk of liquid in movement.

Said ascending stream is preferably generated in such a manner that its velocity is a multiple of the velocity of spontaneous decantation of said crystals in suspension when the cold-accumulating and cooling liquid is immobilized.

Said descending stream is advantageously generated in such a manner that its velocity is inferior to the velocity of spontaneous decantation of said crystals in suspension when cold-accumulating and cooling liquid is immobilized, so as to accumulate said crystals in the form of a porous compact mass in the zone of the descending stream, while letting this cold-accumulating and cooling liquid traverse this mass while being freed of the crystals it contained in suspension before returning to the bottom of the zone of the ascending stream, wherein it is recharged with said crystals produced by the vaporization of the refrigerant.

According to a particular embodiment, said descending stream is generated in such a manner that its velocity is a multiple of said velocity of spontaneous decantation.

To achieve said siphon effect, the volumetric concentration of bubbles is advantageously maintained between 10 and 70% in said ascending stream, by adjusting the rate of liquid refrigerant injected as a function of the flow rate of this ascending stream. To obtain this volumetric concentration of bubbles, this discharge rate is adjusted to vaporize, preferably, in said ascending stream between 150 and 3000 $m^3$ of gaseous refrigerant per hour and per $m^2$ of section of this ascending stream corresponding to a refrigerating capacity lying approximately between 40,000 and 800,000 kcal/h.$m^2$. The velocity of said ascending stream advantageously lies between 0.05 and 2 m/s. The velocity of said descending stream advantageously lies between 0.05 and 2 m/s. The vaporization pressure $P_v$ of the refrigerant is advantageously maintained at a value lying between 1 and 2 bars and the aspiration pressure $P_a$ of the gaseous refrigerant at the top of said cell is maintained at a value approximately near to 1 to 1.5 bar. According to a first embodiment, the flow rate of the refrigerant vaporized in said ascending stream and the flow rate of the cold-accumulating and cooling liquid withdrawn from said cell are adjusted in such a manner that the concentration of said crystals in the gel or the suspension lies between 0.1 and 2%.

According to a second embodiment, the flow rate of the refrigerant vaporized in said ascending stream and the flow rate of the liquid withdrawn from said cell are adjusted in such a manner that the concentration of said crystals in the gel or the suspension lies between 2 and 25%.

According to a particular embodiment, the cold-accumulating and cooling liquid may be withdrawn in the zone of the descending stream and/or in the zone of the ascending stream, to make it circulate in closed circuit through a utililization circuit including at least one heat exchanger and be reinjected into the cell.

According to another embodiment, the cold-accumulating and cooling liquid may be withdrawn from said refrigerating cell, in the zone of the descending stream and/or in the zone of the ascending stream, and it is transferred to a separate cold-storage cell also containing cold-accumulating and cooling liquid, so as to accumulate said crystals in the form of a porous compact mass in this storage cell, while letting this liquid traverse this mass while being freed of the crystals it contained in suspension before returning to the bottom of the zone of the ascending stream, wherein it is recharged with crystals produced by the vaporization of the refrigerant.

Said ascending stream is advantageously generated in at least one vertical tubular element disposed in the cooling cell and associated with at least one injector for refrigerant at least partly in the liquid state, this injector being disposed within this tubular element. In this case, the vaporization of this refrigerant is induced within this element, by direct contact with the cold-accumulating and cooling liquid, to cool this liquid and generate a gel or a fluid suspension of crystals of this frozen liquid and said liquid is discharged in the form of said gel or fluid suspension into the cell at the top of said vertical tubular element. The gaseous refrigerant is collected at the top of the cell.

When said liquid of the cell contains a gel or a suspension of crystals of this frozen liquid, turbulent flow of said liquid is maintained.

To resolve the problem of icing of the injector, the pressure of the refrigerant and of the cold-accumulating and cooling liquid in the vicinity of a zone of injection of the refrigerant into the bulk of this liquid is maintained at a value greater than the saturated vapor pressure of the refrigerant, evaluated at the freezing temperature of the cold-accumulating and cooling liquid, and the pressure of the gaseous refrigerant above said free surface of this liquid is maintained at an aspiration pressure less than this saturated vapor pressure.

According to an advantageous embodiment, said injection is effected in a zone of the cooling cell where the hydrostatic pressure of the cold-accumulating and cooling liquid, augmented by the aspiration pressure of the gaseous refrigerant above the free surface of said liquid, is greater than said saturated vapor pressure, the vaporization of the refrigerant taking place in the bulk of the cold-accumulating and cooling liquid in ascending movement at a height greater than that of the injection zone. Within this frame, said aspiration pressure is preferably maintained at a value from 0.2 to 0.8 bar below said saturated vapor pressure of the refrigerant evaluated at the freezing temperature of the cold-accumulating and cooling liquid.

The refrigerant may be injected at the bottom of a vertical column of cold-accumulating and cooling liquid whose height is at least such that the total pressure of this liquid, in the vicinity of said injection zone, is greater than the saturated vapor pressure of this refrigerant at said freezing temperature.

The injection of the refrigerant may also be effected in the form of a jet discharging within a space, situated within said cooling cell, filled with cold-accumulating and cooling liquid maintained at a pressure $P_1$ greater than said saturated vapor pressure $P_s$, and in that a jet of this liquid is formed discharging from this space into the bulk of the cold-accumulating and cooling liquid contained within this cell, at a pressure $P_2$ less than $P_1$, the jet of said liquid surrounding the refrigerant jet with a sheath, thermally insulating this jet from the body of the injector.

This jet of the cold-accumulating and cooling liquid may be coaxial with the refrigerant jet and the flow rate of the jet of this liquid is advantageously greater than the flow rate of the refrigerant.

It is noted that this method of generating cold is not limited to a utilization for cold storage, but may also be advantageously employed with a view to the transport and exchange of cold in a utilization circuit by means of a cold-accumulating and cooling liquid containing crystals of this liquid in the frozen state in suspension.

In this case, the cold-accumulating and cooling liquid is preferably made to circulate in closed circuit outside the cooling cell, by withdrawing from this cell cold-accumulating and cooling liquid charged with said gel or said suspension of crystals of fluid consistency, by making this liquid circulate through at least one heat exchanger, and by then returning this liquid to said cell. At least a part of said crystals is melted in said heat exchanger, and said liquid is transferred to the storage cell by maintaining, preferably without interruption, a flow of cold-accumulating and cooling liquid sufficient to maintain therein turbulent flow at every point between the two cells to avoid the formation of agglomerated plugs of ice crystals.

The device for implementing this method such as defined above is characterized in that said means for injecting and vaporizing the refrigerant are adapted to inject and vaporize this refrigerant in a limited part of the horizontal section of the cooling cell, in such a manner as to generate in said cooling cell, by siphon effect, a stream of liquid in closed hydraulic circuit, this stream including at least one ascending stream of cold-accumulating and cooling liquid contained in the cooling cell, this stream being located substantially above said means for injecting the refrigerant and containing bubbles of vaporized refrigerant, and at least one descending stream essentially free of gaseous refrigerant.

According to an advantageous embodiment, said means for injecting the refrigerant include at least one injector surmounted by a vertical column of cold-accumulating and cooling liquid whose height is at least such that the hydrostatic pressure produced in the injection zone, augmented by the aspiration pressure of the gaseous refrigerant at the top of the cooling cell, is greater than the saturated vapor pressure of the refrigerant fluid evaluated at the freezing temperature of said liquid.

According to another embodiment, the cooling cell preferably includes at least one tubular element constituting a vertical chimney with cylindrical wall surfaces, and also injection means disposed within this vertical chimney, this chimney being open at its bottom extremity to enable the admission of cold-accumulating and cooling liquid and at its upper extremity to enable discharge of this cooled liquid or of a gel or a suspension composed of this liquid and crystals of this frozen liquid into the annular space included between this tubular element and the vertical walls of the cooling cell. The section of the tubular element is preferably similar to the section of said annular space.

When the device includes a single cell for generating cold and storing said crystals, the section of the tubular element is advantageously a fraction of the section of said annular space.

According to an advantageous embodiment to enable solving the problem of icing, the cooling cell and said means for injecting the refrigerant are adapted to maintain the pressure of the cold-accumulating and cooling liquid and of the refrigerant in the vicinity of the injection zone, at a value greater than this vaporization pressure of the refrigerant, evaluated at the freezing temperature of the cold-accumulating and cooling liquid.

According to an advantageous embodiment, said means for injecting the refrigerant comprise at least one injector immersed in the bulk of the cold-accumulating and cooling liquid, contained in said cell, surmounted by a vertical column of this liquid whose height is at least such that the hydrostatic pressure produced in the injection zone, augmented by the aspiration pressure of the gaseous refrigerant, is greater than the saturated vapor pressure of this refrigerant, evaluated at the freezing temperature of the cold-accumulating and cooling liquid.

The cell preferably includes at least one tubular element constituting a vertical chimney with cylindrical wall surfaces, as also refrigerant injecting means disposed in the lower part of this vertical chimney.

In this case, the upper extremity of the vertical chimney is disposed above the free level of the cold-accumulating and freezable cooling liquid, contained in the cooling cell, and it is surmounted by a deflector adapted to channel said liquid containing crystals of this frozen liquid in suspension and/or for preventing this liquid from being carried along by the gaseous refrigerant aspirated at the top of the cooling cell by a compressor.

In the case where the device includes a first cooling cell and a second, cold-storage cell, the two cells being interconnected by a circuit designed to convey a mixture of cold-accumulating and cooling liquid and frozen crystals of this liquid, in the form of a gel or a suspension of fluid consistency, the means for injecting the refrigerant are disposed in the lower part of the cooling cell.

According to another advantageous embodiment, said injecting means include a chamber connected to an admission for cold-accumulating and cooling liquid under pressure and provided with an outlet opening into the cooling cell, and a nozzle for injecting the refrigerant into this chamber towards the outlet, in such a manner that the jet of refrigerant thus formed is surrounded by a moving sheath of cold-accumulating and cooling liquid which insulates it from the walls of this chamber.

Said nozzle may be replaced by an injection pipe consisting of a central tube provided with a series of injection orifices and surrounded by a coaxial tube provided with a series of outlet orifices disposed facing the injection orifices, these orifices being adapted two by two to form a series of injectors.

BRIEF DESCRIPTION OF THE DRAWINGS

The present invention will be better understood with reference to the description of examples of preferred embodiments and the accompanying drawings wherein:

FIG. 3 represents a modification of the embodiment of FIG. 2.

FIG. 4 represents a particular form of a refrigerant injector, and

DETAILED DESCRIPTION OF THE INVENTION

Figure 1:
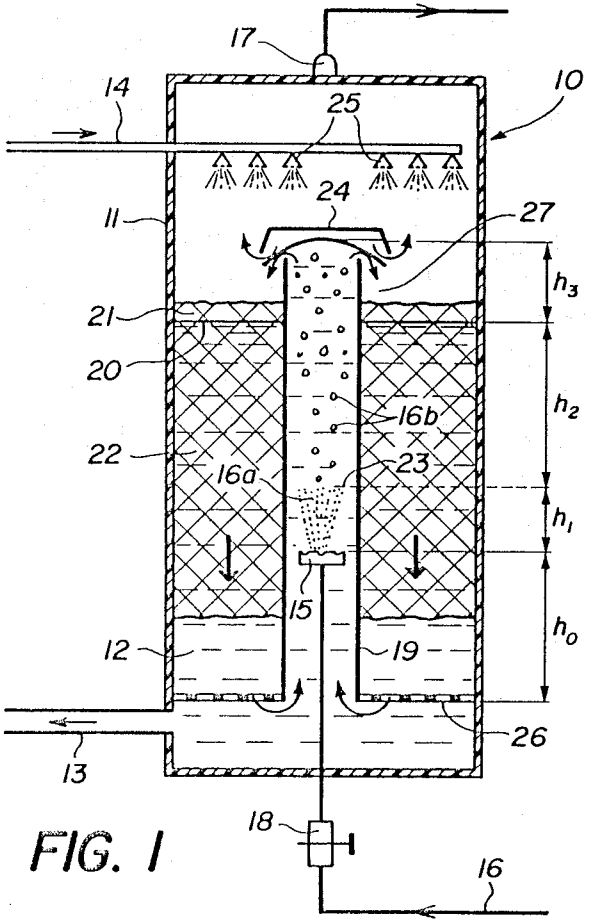
FIG. 1 represents an advantageous embodiment of a device according to the invention wherein the generation and the accumulation of cold are effected in the same cell.

FIG. 1 illustrates a first embodiment of a device for generating and utilizing cold, which includes a cooling cell 10 which is surrounded by a thermal insulating sheath 11 and contains a mass 12 of freezable cold-accumulating liquid which also serves as a coolant in a utilization circuit (not shown), comprising heat exchangers for example, and equipped with an outlet line 13 for this cold liquid and with a return line 14 for this liquid reheated in the utilization circuit. An injector 15 for refrigerant 16 is disposed within the cell 10 below the free level 20 of the mass of liquid 12. An aspiration orifice 17 for refrigerant 16, in the gaseous state, is provided at the upper extremity of this cell.

The external circuit of the refrigerant includes, for example, in a manner known per se, a compressor (not shown) connected to the aspiration orifice 17 and a condenser (not shown) connected to the injector 15, via a control valve 18 permitting the flow rate of the refrigerant injected into the bulk of the cold-accumulating and cooling liquid 12 and consequently the refrigerating capacity of the installation to be controlled. The injector has the object of injecting refrigerant in the liquid or partly liquid state into the liquid 12. The aspiration orifice 17 is provided at the upper extremity of the cell 10 in such a manner as to be able to collect the refrigerant in the gaseous state above the free level 20 of the liquid 12 at an aspiration pressure lower than the saturated vapor pressure $P_s$ of the refrigerant.

The injector 15 is disposed within a tubular element 19 in the form of a cylindrical chimney, open at its two extremities, of which the upper extremity opens above the free level 20 of the liquid 12 contained in the cell 10.

In the illustrated example, the pressure exerted on the refrigerant at the moment of its injection into the liquid 12, is equal to the pressure of the gaseous refrigerant filling the top of the cell 10 augmented by the hydrostatic pressure of the liquid column surmounting the injector 15.

This pressure is maintained at a value greater than the saturated vapor pressure $P_s$ of the refrigerant evaluated at the freezing temperature of the liquid 12 at which the latter lies on account of its passage in the mass of crystals as described hereinafter. This pressure is thus sufficient to prevent the vaporization of the refrigerant in the liquid phase immediately at the outlet of the injector. Due to this, one suppresses any risk of icing of the orifices and the inner and outer wall surfaces of the injector.

The refrigerant, for example isobutane or preferably octafluorocyclobutane C4F8 designated by R-C318, may either be totally in the liquid state, or preferably partly in the gaseous state at the outlet of the expansion valve 18 depending on its temperature on arrival through the line 16 in this valve 18. The gas bubbles, not shown, accompanying the droplets **16*a* of liquid refrigerant leaving the injector 15 bring into ascending movement the whole column of cooling and cold-accumulating liquid bounded by the tubular element 19 and overlying the injector 15, thus drawing along these droplets 16*a* even if their specific mass is greater than that of said accumulating liquid (case of R-C318). During their ascent, the droplets are vaporized and other bubbles 16*b* are formed in the column, above the injector 15, at the point where the pressure is reduced to a value close to $P_s$. Due to the reduction of the mean density of the liquid in the column contained in the element 19 and induced by the presence of the bubbles, an ascending stream is rapidly created by siphon effect within the tubular element 19 and a descending stream in the annular space situated between the tubular element 10 and the vertical wall of the cell 10**.

The vaporization of the refrigerant in the bulk of the accumulating liquid contained in the chimney 19 progressively lowers the temperature of this liquid down to its freezing temperature and then generates, thanks to the existence of an ascending stream with a high flow rate, a gel or suspension of microscopic crystals of frozen cold-accumulating and cooling liquid , of perfectly fluid consistency, and whose weight concentration of crystals is low, in the order of a fraction of a part per thousand to a few percent.

Thanks to the fact that the velocity of the ascending stream of the liquid within the tubular element 18 is greater than the velocity of spontaneous decantation of the crystals forming the gel or the suspension 27 when the liquid is immobilized, the latter remains homogeneous.

The crystals contained in the gel or the suspension 27 are separated from the cold-accumulating and cooling liquid in said annular space because the velocity of the descending stream of liquid in this space is inferior to the velocity of spontaneous decantation of said crystals.

This result, which is essential for proper operation of the installation as a cold-accumulator, is obtained by giving the section of the tubular element 19 a value which is a fraction of that of the section of said annular space.

In practice, when crystals have already been accumulated in the cell 10, the free level 20 of the accumulator liquid contained in the cell defines a surface of separation between a porous upper layer 21 of practically dry crystals of frozen cold-accumulating and cooling liquid , formed for example of water or of a solution of mineral salts in water or another aqueous solution, and a lower layer 22 of these same crystals impregnated with this liquid.

Thanks to the fluid consistency of the gel or the suspension, the crystal masses 21 and 22 have a a porous structure which is much more homogeneous and compact than those formed hitherto in cold-storage cells where one accumulated macroscopic crystal aggregates of solid consistency mixed with freezable liquid.

The circulation in closed circuit, generated within the cell 10, results in that the liquid 12 circulates permanently through the layers of crystals 21 and 22 while being maintained at a temperature very near to the freezing temperature of this liquid. This liquid charged with cold is discharged through the outlet line 13 to the utilization circuit during the cold-restitution phases. It is totally recycled through the tubular element 19 during the cold-accumulating phases and partially during the cold-restitution phases.

For the device to be able to function appropriately, that is, for the condition relating to hydrostatic pressure at the level of the injector to be effectively achieved, the height of the cell 10 must be sufficient. In practice, the nature of the refrigerant, the aspiration pressure of this fluid in the gaseous state above the free level of the liquid 12 within the cell 10 and the height of said free level must be chosen in such a manner that the saturated vapor pressure of the refrigerant, evaluated at the freezing temperature of the liquid 12, is inferior to the sum of said aspiration pressure and the hydrostatic pressure of this liquid at the level of the injector.

The refrigerant is chosen in such a manner that the suction pressure $P_a$ is close to atmospheric pressure to minimize the cost of the cell 10, and preferably slightly greater than atmospheric pressure to avoid any risk of air entering into the cell. This condition is fullfilled with isobutane and the perfluorinated refrigerant R-C318.

Let $h_1$ be the height of the liquid column surmounting the injector up to the vaporization level 23 of the refrigerant droplets 16*a*, $h_2$ the height of the column going from the vaporization level 23 to the free level 20 of the liquid separating the porous mass of ice crystals 22 impregnated with water from the porous mass of dry crystals 21, and $h_3$ the height between this free level 20 and the upper level of the liquid discharging from the chimney 19; $h_3$ must be greater than the maximum thickness of the dry layer 21. The height $h_1$ advantageously lies between 0.5 and 2 m, while the height $h_2+h_3$ advantageously lies between 0.5 and 4 m. A too great height $h_2+h_3$ would result in a too great pressure difference between the saturated vapor pressure $P_s$ of the refrigerant prevailing at the evaporation level 23 and the aspiration pressure $P_a$ at the top of the cell 10, and would necessitate too great compression work, the consequence being a lowering of the thermodynamic efficiency of the installation. To limit the height $h_2+h_3$, the injector 15 may be disposed at a certain height $h_o$ within the tubular element 19, when the height of the storage cell 10 is great.

If the maximum height of the crystal mass formed by the layers 21 and 22 surpasses 3 to 4 meters, it may be advantageous to give the height $h_o$ a sufficient value for the hydrostatic pressure of the column of height $h_1+h_2+h_3$ to be limited, for example to 3 meters, in order to avoid that the aspiration pressure of the gaseous refrigerant should be, to produce the vaporization of this fluid, too far below the saturated vapor pressure $P_s$, which would be prejudicial to the thermodynamic efficiency of the installation.

In order that the device may function, and moreover with a good thermal exchange between the crystal masses 21 and 22 and the cold-accumulating and cooling liquid in circulation, there must be created in the cell, by siphon effect, an intense ascending stream of the liquid along a column disposed above the injector, for example within the cylindrical element 19, and a stream descending around this column, through the mass of crystals.

This objective is achieved if:

$$\Delta P=\rho_1 \cdot g \cdot h_2-\rho_m \cdot g \cdot (h_2+h_3)>0 \quad (1)$$

where $\rho_1$ is the specific mass of the cold-accumulating and cooling liquid and $\rho_m$ the mean specific mass of the column of accumulating liquid charged with bubbles overlying the evaporation level 23.

One has:

$$\rho_m \approx \rho_1 \cdot (1-C) \quad (2)$$

where C is the mean concentration by volume of gaseous refrigerant bubbles in this column.

A numerical example will help to understand functioning of the system. With a mean concentration of bubbles C in the order of 20%, $\rho_m=0.8\rho_1$. (1) then gives:

$$H_2-0.8(h_2+h_3)>0 \quad (3)$$

From which:

$$h_2>4h_3 \quad (4)$$

Let H be the maximum height of the mass 22 of crystals impregnated with liquid at the end of an accumulating phase. If the porosity of the dry mass 21 overhanging the free level 20 is substantially the same as that of the mass 22, the thickness of the mass 21 is about 0.1.H for cold-accumulating and cooling liquids consisting essentially of water.

For example, if H=3 m, this thickness is 0.3 m; as $h_3$ must be superior thereto for ensuring a correct overflow of the accumulating liquid above its surface, $h_3=0.5$ m.

The relationship (4) then gives $h_2>2$ m.

In practice, one will take for example $h_2=2.5$ m for an ascending stream of sufficient flow rate to be established in the chimney 19.

Consequently $h_2+h_3=3$ *m*.

The hydrostatic pressure ΔP of the column of liquid situated above the vaporization level is:

$$\Delta P=\rho_m \cdot g \cdot (h_2+h_3) \quad (5)$$

In the example considered:

$$\rho_m=0.8.10^3 \text{ kg/m}^3, \text{ so that } P=0.24 \text{ bar.}$$

Consequently, the aspiration pressure $P_a$ of the gaseous refrigerant prevailing in the upper part of the cell 10 must be adjusted at a value 0.24 bar below the pressure prevailing in the chimney at the vaporization level 23, which pressure is substantially equal to the saturated vapor pressure $P_s$ of the refrigerant at the freezing temperature of the liquid, that is to say 0° C. in this example.

If $P_s$ at 0° C. amounts to 1.28 bar (R-C318 refrigerant), the suction pressure $P_a$ must be about 1.04 bar.

If, to avoid any risk of icing of the injector 15, one takes $h_1=1$ m the pressure $P_1$ prevailing in the liquid in the vicinity of the refrigerant injection zone is then 1.28+0.1=1.38 bar.

Experience generally shows that the device described above readily enables obtaining a mean volumetric bubble concentration C lying between 10 and 70% at the top of the chimney 19 and a concentration of microscopic ice crystals forming said gel or said suspension in the liquid discharged from the top of this chimney 19 of the order of a fraction of a per cent to a few per cent.

The refrigerating capacity of the system per $m^2$ of section of the chimney usually lies between: 40,000 and 800,000 kg.cal/h.$m^2$ and the corrseponding discharge rate of vaporized refrigerant lies between: 150 and 3,000

$m^3/h.m^2$ when the refrigerent consists of isobutane (R-600a) or octafluorocyclobutane (R-C318).

The ascending stream must generally have a velocity sufficient to prevent the formation by decantation of a plug of agglomerated ice crystals liable to obturate the upper part of the chimney. This velocity usually lies between 0.05 m/s and 2 m/s and is preferably greater than 0.3 m/s.

The chimney 19 is surmounted by a deflector 24 designed to prevent throwing up liquid into the aspiration line 17 and for the gel or the suspension of ice crystals which are generated by evaporation of the refrigerant in the column of liquid bounded by this chimney, to be discharged onto the upper surface of the layer of dry crystals 21 in a quite uniform manner.

Thanks to the circulation of the liquid 12 in closed circuit in the cell 10, this liquid is propelled with a sufficiently rapid ascending movement in the chimney 19 to prevent the formation of any plug of ice crystals by decantation at the top of this chimney. This velocity is moreover sufficient to ensure a good separation between the gaseous refrigerant and the liquid in the region where it is discharged from the chimney into the space filled with gaseous refrigerant situated in the upper part of the cell 10, in which region the thickness of the moving stream of liquid is small.

The overflow formed by the upper extremity of the tubular element 19 prevents the liquid from being carried along with the gaseous refrigerant aspirated by the compressor connected to the aspiration orifice 17.

The return line 14 of the utilization circuit is equipped with a series of sprinkling or spraying members 25 designed to uniformly distribute, in the form of a fine rain, the cold-accumulating and cooling liquid reheated after its passage in the utilization circuit onto the entire surface of the dry crystals.

A screen 26 is provided at the base of the cell 10, above the outlet pipe 13, to prevent partial obstruction of the bottom of the cell 10 by crystals of solidified liquid when the layer of crystals 22 thickens and substantially fills the whole inner space of this cell 10, at the end of a cold-accumulation phase.

One thus avoids that, during a subsequent cold-restitution phase, the stream of liquid is concentrated on a portion of the mass of crystals, which could lead to non-uniform fusion of this mass. One also suppresses any risk of obstruction of the line 13.

In the illustrated example, the cell 10 and also the chimney 19 are cylindrical whether with a circular section or not, while their wall surfaces do not present any roughness liable to catch the crystal layers 21 and 22. During the phase for generating and accumulating cold, the layer of dry crystals tends to thicken given that new crystals are constantly discharged by the upper opening of the chimney 19. This layer thickens and becomes heavier and results in progressive sinking of the mass of crystals. During the phase for utilizing the stored cold, the fusion of the crystals of solidified liquid takes place more rapidly at the top than at the bottom of the mass. The upper layer is in effect constantly sprayed with reheated liquid which is cooled progressively while traversing the mass. On account of this more rapid superficial fusion, the mass floating on the liquid will tend to rise by buoyancy. This rise takes place globally, without cracking or reorganization of the structure, in the manner of a piston sliding along the wall surfaces, on condition that these wall surfaces be smooth, cylindrical and do not present any roughness liable to brake or hold back the crystals in their displacement.

The physical conditions mentioned above may also be obtained in other installations or by making different parameters vary, which enables to lead to various embodiments described in more detail below.

Figure 2:
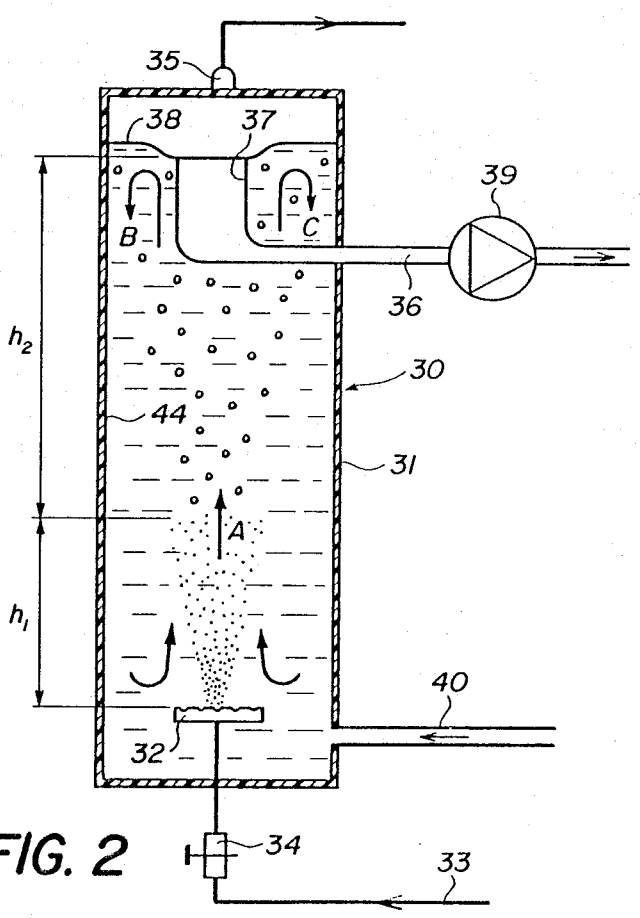
FIG. 2 represents a partial schematic view of the device according to the invention wherein the generation of cold is effected in a different cell than that in which the accumulation is effected.

FIG. 2 describes an installation for refrigerating and/or crystallizing a cold-accumulating and cooling liquid utilizing substantially the same fundamental principles as those which have been implemented in the previous installation, but where the function of accumulating ice crystals for storing cold is separated from the function of generating crystals. This installation includes a cooling cell 30 surrounded by a thermally insulating sheath 31 and by a crystal-storage cell (not shown).

The cell 30 is equipped at its bottom end with one or several injectors 32 disposed on a portion of the horizontal section of the cell 30 and fed with refrigerant 33 supplied by a feed line on which a control valve 34 is mounted. The role of the valve 34 is to adjust the flow rate of the vaporized liquid refrigerant leaving the condenser (not shown) at a pressure of the order of 4 bar and injected into the liquid at a pressure in the vicinity of 2 bar. The top of the cell 30 is provided with a line 35 for aspiration of the refrigerant in the vapor state at a pressure in the order of 1 bar for example, by a compressor, not shown.

As before, the injection pressure and/or the height of the column of accumulating liquid are chosen in such a manner that the refrigerant is injected in liquid form, possibly mixed with some vapor bubbles, created in the valve 34, and is only vaporized at a certain height $h_1$ within the cell 30. This vaporization results in cooling of the liquid and then the formation of microscopic crystals of this frozen liquid. These crystals are mixed with the liquid and form a gel or a very fluid suspension which is pumped over and concentrated in a storage cell of cylindrical form, substantially identical with the cell 10 of FIG. 1, but lacking the central chimney 19. A discharge line 36 opens at 37 in the vicinity of the free surface 38 of the liquid to collect the fluid suspension and to transport it via a pump 39 to the storage cell previosly mentioned. A return line 40 enables supplying to the bottom of the cell 30 the liquid freed of crystals recovered from the bottom of the storage cell.

As is shown by the arrows A, B and C, a stream is established in the cell 30 by siphon effect ascending at the centre of this cell and descending in the vicinity of its outer wall 44. This flow rate is a multiple of the flow rate of the liquid withdrawn from the cell 30 by the pump 39.

As before, this intense liquid stream in closed circuit in the cell 30, prevents the formation of any plug of crystals agglomerated by spontaneous decantation of these crystals in the vicinity of the free surface 38 of this liquid and also ensures an effective separation of the gaseous refrigerant vaporized in its bulk.

One may also make the liquid withdrawn from the cell 30 by the pump 39 circulate through a heat exchanger (not shown) instead of through a cold-storage cell as previously described. In this case, the cell 30 may function either as a crystallizing cell where the gel or the suspension of crystals mentioned above is produced, or as a cell for cooling the liquid, without freezing, according to the value of the flow rate of this liquid circulating through this heat exchanger. In both cases, the liquid streams in closed circuit generated in the cell 30 by siphon effect, as previously described, ensure a good separation, in the vicinity of the free surface 38 of the liquid mass, between this liquid and the gaseous refrigerant contained in this liquid.

In the case where the cooling cell 30 functions as a crystallizing cell, one maintains the flow rate of the accumulating liquid charged with said suspension of crystals of this frozen liquid, of fluid consistency, put in circulation by the pump 39, at a value sufficient for the flow of this liquid to be turbulent across the hydraulic circuit comprising the line 36, the pump 39 and the utilization circuit not shown comprising at least one heat exchanger, and also the line 40 if the return liquid still contains ice crystals, in such a manner as to prevent any decantation of the crystals and any formation of a plug of ice within this hydraulic circuit.

This cooling and/or crystallizing cell is particularly simple and enables the use of standardized cylindrical vessels for fabricating the cells. It further enables the implementation of a modular concept, based on the utilization of a single cell sequentially or continuously feeding a group of cold-storage cells and/or heat exchangers mounted in parallel or in series in a utilization circuit. The storage cells may have a cylindrical form of circular section, a rectangular or square section, and be juxtaposed or distant from each other.

The crystallizing cell may be mounted in proximity of or at a distance from the cold-storage cells as needed or according to the space available. A centralized, possibly programmed, control may be designed to monitor the entire installation automatically. Such an equipment is of course conceivable only for large installations. One of its advantages is due to the fact that the entire installation may be adapted to the development of requirements by the addition or suppression of one or several storage cells. Besides, all vital members subject to a certain wear and requiring a certain maintenance are perfectly accessible and replaceable.

FIG. 3 illustrates a variant of the refrigerating and/or crystallizing installation illustrated in FIG. 2. It includes as before a cooling cell 50 surrounded by an insulating sheath 51 and containing a cold-accumulating and cooling liquid 52 withdrawn from the annular space included between the tubular element 55 and the cell wall by a discharge line 53 and reinjected within the cell via the pump 39 and a return line 54 at the bottom of the tubular element 55 surmounted by a deflector 56. As before, this element is intended to facilitate the discharge of the mixture of liquid and crystals of this frozen liquid or simply of cooled liquid free of crystals, in the direction of the arrows A and to contribute to degassing, that is to say to the effective separation of the gaseous refrigerant from the liquid. In the represented embodiment, the discharge line 53 has its opening in the annular space provided between the walls of the cell and the tubular element 55. However, one may also envisage withdrawing the cooled liquid from the interior of the tubular element. To this end, a duct 53' represented in dashed lines opens within this element, below the zone of injection of the refrigerant.

Figure 5:
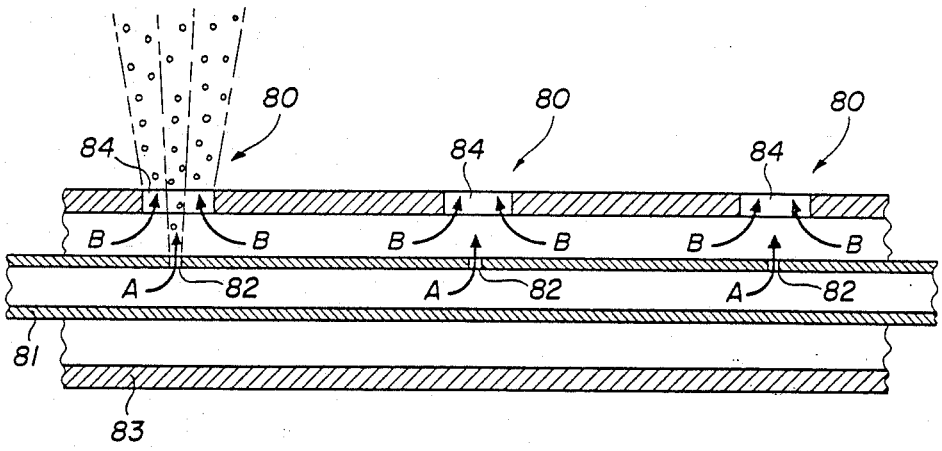
FIG. 5 represents a sectional view of a pipe of refrigerant injectors which may be utilized in any one of the devices illustrated in the FIGS. 1 to 3.

At least one injector 57 of the type represented in detail in FIGS. 4 and 5, is disposed within the tubular element 55. This injector is supplied with refrigerant by a line 58 connected to a control valve 59 and with liquid by the line 65 by means of a pump 64. As before, the refrigerant is collected in the gas phase at the top of the cell 50 by a line 60.

The bubbles formed by vaporization of this refrigerant fluid induce, by siphon effect, a stream of liquid ascending in the tubular element 55 and a stream descending outside this element, as is shown by the arrows A. A part of the cooled liquid or mixture of this liquid with crystals of this frozen liquid is recycled, as is shown by the arrows B. Another, much smaller part is drawn off through the discharge line 53, by the pump 39 whose outlet is connected to the actual inlet of a utilization circuit.

The utilization circuit may again be formed of a cell for accumulating crystals and/or at least one heat exchanger. At the outlet of the utilization circuit, the liquid may be partially or totally freed of the crystals which it contained on entry into this circuit and be reheated above its freezing temperature when the utilization cicuit comprises heat exchangers.

One manages, by adjusting by means of the valve 59 the flow rate of vaporized refrigerant which determines the refrigerating capacity of the installation, to make the velocity of the liquid circulating in closed circuit in the cell in every respect sufficient to prevent any formation of a plug of ice crystals agglomerated in the vicinity of the free surface 63 of the liquid by decantation of these crystals. Besides, one manages, by adjusting the flow rate of the liquid extracted by the pump 61 as a function of the flow rate of evaporated refrigerant, to make the gel or the fluid suspension of crystals in circulation in closed circuit in the cell 50 have a given concentration, lying for example between 0.1 and 25%.

As mentioned before with reference to FIGS. 1 and 2, the refrigerant, in the liquid phase may be more or less dense than the cold-accumulating and cooling liquid. In the latter case, it would be advantageous to provide at the base of one of the cells represented in FIGS. 1 to 3, a discharge orifice communicating with an aspiration pump for recovering any refrigerant which has not evaporated after its injection, and which may have accumulated with time at the bottom of the crystallizing cell.

To avoid the risk of icing of the injector in the cells represented in FIGS. 1 to 3, particularly when the total height of the cell (case of FIG. 3) is limited, and consequently insufficient to enable achieving hydrostatically the conditions for suppression previously defined with reference to FIGS. 1 and 2, one obtains this suppression dynamically.

To this end, the injector 57 in FIG. 3 is formed of the injector represented in FIG. 4. It is composed of a chamber 71 supplied with cold-accumulating and cooling liquid by the pump 64, through the line 65, at a pressure greater than the saturated vapor pressure of the refrigerant evaluated at the freezing temperature of the liquid, this chamber 71 opening into the crystallizing cell by at least one outlet orifice 73, in a zone where the pressure of the liquid may be equal to or even less than said saturated vapor pressure $P_s$. The refrigerant, coming from the control valve 59, is injected under pressure within the chamber 71 by at least one nozzle towards the outlet 73. Thus, the jet of liquid refrigerant is surrounded by a sheath of liquid which thermally insulates it from the mass of the injector, which prevents icing of the latter in spite of the fact that the vaporization of the refrigerant begins to occur already within the orifice 73 inside which the pressure drops rapidly.

A variant of such an injector is represented in FIG. 5. In that case, the individual injector of FIG. 4 is replaced by a pipe of injectors 80, composed of the combination of a central tube 81 provided with a series of calibrated orifices 82 and surrounded by a peripheral tube 83 provided with a series of orifices 84 disposed respectively facing the orifices 82. The tube 81 is intended to convey the refrigerant under pressure and the peripheral tube 83 is intended to convey liquid also under pressure. On account of the disposition and the dimensions of the respective orifices 82 and 84, the refrigerant is injected in the form of a fine jet, illustrated by the arrows A, into a sheath of cold-accumulating and cooling liquid illustrated by the arrows B.

In practice, the orifices 84 are dimensioned in such a manner that the flow rate of the liquid is approximately from two to twenty times greater than the flow rate of the refrigerant. As before, the refrigerant is surrounded by a sheath of liquid which insulates it from the tube 83 of the injector, thus preventing icing the latter, in spite of the fact that the vaporization of the refrigerant begins already within the tube 83.

The two examples injector embodiments illustrated in FIGS. 4 and 5 make it possible to dynamically create conditions equivalent to those obtained statically by the hydrostatic pressure prevailing at the level of the injector when the cell containing the liquid has a sufficient height. They present the advantage of enabling the use of crystallizing cells of small height due to the fact that the vaporization of the refrigerant is effected at the level of the injector 57.

If $P_f$ is the pressure of the refrigerant in the injection nozzle 70 or in the central tube 81 in the case of FIG. 5, $P_1$ the pressure of the accumulating liquid in the injecting chamber 71 or within the tube 83 respectively and $P_2$ its pressure in the cell 50, in the vicinity of the injection orifices, these quantities will be linked in the following manner:

$$P_f > P_1 > P_2$$

Moreover, one will necessarily have the following relationships:

$$P_1 > P_s \text{ and } P_s > P_a$$

in order that the system may function, $P_s$ and $P_a$ having the significance already given before.

With reference to FIGS. 2 to 5, the concentration of the crystals in suspension in the liquid, produced in the crystallizing cells is a function of the ratio existing between the flow rate of the liquid withdrawn from these cells and the refrigerating capacity of the installation determined by the flow rate of the vaporized refrigerant.

By sufficiently increasing this ratio, it is possible to cool the liquid withdrawn from these cells without freezing it. In this case, the crystallizing cells function as economical refrigerating installations for cooling with a high thermodynamic efficiency of a cold-accumulating and cooling liquid to a temperature greater than its freezing temperature, while at the same time ensuring a good separation between the gaseous refrigerant and this liquid.

The present invention is not limited to the described embodiments but may undergo various modifications and may have different variants obvious to one skilled in the art.

We claim:

1. In a method of generating cold and using it either directly or indirectly after transient storage and restitution, wherein cooling and/or partial freezing of a cold-accumulating and cooling liquid partially filling a cooling cell is effected by injecting a refrigerant at least partly in the liquid state into a mass of said cold accumulating and cooling liquid in said cooling cell, vaporizing said refrigerant directly in said liquid, by collecting the refrigerant in the gaseous state at the upper part of said cooling cell, above a free surface of the cold-accumulating and cooling liquid, wherein the cold-accumulating and cooling liquid is withdrawn from said cell, and is conveyed in a cold-utilization circuit and/or at least one cold-storage cell, then is reintroduced into said cooling cell, the improvement wherein a stream of liquid in closed hydraulic circuit is generated in said cooling cell during injection of said refrigerant, said stream including at least one ascending stream of cold-accumulating and cooling liquid, located substantially above a zone of injection of said refrigerant at least partly in the liquid state, said zone of injection being located on a portion of a horizontal section of said cell, said stream further including at least one descending stream formed essentially of cold-accumulating and cooling liquid free of said gaseous refrigerant, wherein said stream in closed hydraulic circuit is produced by a siphon effect induced by reduction of the mean density of the mixture of liquid and bubbles of vaporized refrigerant above said injection zone, and wherein the rate of injection of said refrigerant is adjusted in such manner that vaporization thereof generates a gel or a fluid and homogeneous suspension of crystals of cold-accumulating and cooling liquid frozen in the bulk of said liquid in movement.

2. Method according to claim 1 wherein said ascending stream is generated in such a manner that its velocity is a multiple of the velocity of spontaneous decantation of said crystals in suspension when the cold-accumulating and cooling liquid is immobilized.

3. Method according to claim 1, wherein said descending stream is generated in such a manner that its velocity is inferior to the velocity of spontaneous decantation of said crystals in suspension when the cold-accumulating and cooling liquid is immobilized, so as to accumulate said crystals in the form of a porous compact mass in the zone of the descending stream, while at the same time letting this cold-accumulating and cooling liquid traverse this mass while being freed of the crystals it contained in suspension before returning to the bottom of the zone of the ascending stream, wherein it is recharged with said crystals produced by the vaporization of the refrigerant.

4. Method according to claim 3, wherein said ascending stream is generated in at least one vertical tubular element disposed in the cooling cell and associated with at least one injector for a refrigerant at least partly in the liquid state, this injector being disposed within this tubular element, wherein the vaporization of this refrigerant is induced within this element by direct contact with the cold-accumulating and cooling liquid, to cool this liquid and generate a gel or a fluid suspension of crystals of frozen cold-accumulating and cooling liquid, wherein this liquid is discharged in the form of a gel or fluid suspension into aid cell at the top of said vertical tubular element, and herein the refrigerant is collected in the gaseous state at the top of this cell.

5. Method according to claim 1, wherein said descending stream is generated in such a manner that its velocity is a multiple of said velocity of spontaneous decantation.

6. Method according to claim 5, for conveying cold generated in said cooling cell, wherein the cold-accumulating and cooling liquid is made to circulate in closed circuit outside the cooling cell, by withdrawing from this cell cold-accumulating and cooling liquid charged with said gel or said suspension of crystals of fluid consistency, by making this liquid circulate through at least one heat exchanger and then making this liquid return to said cell, and in that at least a part of said crystals is made to melt in said heat exchanger and in that a flow of cold-accumulating and cooling liquid is maintained which is sufficient to maintain turbulent flow at every point therein without interrupting said closed circuit.

7. Method according to claim 1, wherein the cold-accumulating and cooling liquid is withdrawn, in the zone of the descending stream and/or in the zone of the ascending stream, below said injection zone, to make it circulate in closed circuit through a utililization circuit including at least one heat exchanger and in that it is reinjected into the cell.

8. Method according to claim 1, wherein the cold-accumulating and cooling liquid is withdrawn from said cooling cell, in the zone of the descending stream and/or in the zone of the ascending stream, below said injection zone, and wherein said liquid is transferred to a separate cold storage cell also containing cold-accumulating and cooling liquid, in such a manner as to accumulate said crystals in the form of a porous compact mass in this storage cell, while letting the cold-accumulating and cooling liquid traverse this mass while being freed of the crystals it contained before returning to the bottom of the zone of the ascending stream, where said liquid is recharged with crystals produced by the vaporization of the refrigerant.

9. Method according to claim 7, wherein said cold-accumulating and cooling liquid contained in the cooling cell contains a gel or a suspension of crystals of this frozen liquid, and wherein said liquid is transferred to the storage cell by maintaining turbulent flow of said liquid to avoid the formation of plugs of agglomerated ice crystals between the two cells.

10. Method according to claim 1, wherein the pressure of the refrigerant and of the cold-accumulating and cooling liquid in the vicinity of a zone of injection of the refrigerant into the bulk of this liquid is maintained at a value superior to the saturated vapor pressure of the refrigerant, evaluated at the freezing temperature of the cold-accumulating and cooling liquid, and in that the pressure of the refrigerant in the gas phase above said free surface of this liquid is maintained at an aspiration pressure lower than this saturated vapor pressure.

11. Method according to claim 10, wherein said injection is effected in a zone of the cooling cell where the hydrostatic pressure of the cold-accumulating and cooling liquid, augmented by the aspiration pressure of the refrigerant in the gas phase above the free surface of said liquid, is greater than said saturated vapor pressure, the vaporization of the refrigerant taking place in the bulk of the cold-accumulating and cooling liquid in ascending movement at a height greater than that of the injection zone.

12. Method according to claim 11, wherein said aspiration pressure is maintained at a value 0.2 to 0.8 bar below the saturated vapor pressure of the refrigerant evaluated at the freezing temperature of the cold-accumulating and cooling liquid.

13. Method according to claim 11, wherein the refrigerant is injected at the bottom of a vertical column of cold-accumulating and cooling liquid whose height is at least such that the total pressure of this liquid in the vicinity of said injection zone is superior to the saturated vapor pressure of this refrigerant at said freezing temperature.

14. Method according to claim 10, wherein the injection of the refrigerant is effected in the form of a jet discharging within a space, situated within said cooling cell, filled with the cold-accumulating and cooling liquid maintained at a pressure $P_1$ greater than said saturated vapor pressure $P_s$, and in that a jet of this liquid is formed discharging from this space into the bulk of cold-accumulating and cooling liquid contained within said cell, at a pressure $P_2$ less than $P_1$, the jet of said liquid surrounding the jet of refrigerant with a sheath, thermally insulating this jet from the body of the injector.

15. Method according to claim 14, wherein the jet of the cold-accumulating and cooling liquid is coaxial with the jet of refrigerant and in that the discharge rate of the jet of this liquid is greater than the discharge rate of the refrigerant.

16. In a device for generating cold and using it either directly or indirectly after transient storage and restitution, including at least one cooling cell adapted to contain a cold-accumulating and cooling liquid in the lower portion thereof and to provide a liquid-free space in the upper portion thereof, means communicating with said cell for injecting and vaporizing a refrigerant at least partly in the liquid state into a mass of cold-accumulating and cooling liquid in said cell, means for collecting said refrigerant in the gaseous state at said upper part of said cell above a free surface of the cold-accumulating and cooling liquid, and means communicating with said cell for withdrawing cold-accumulating and cooling liquid from said cell and for conveying it in a circuit for cold utilization and/or to at least one cold storage cell, and then reintroducing it into said cooling cell, the improvement wherein said means for injecting and vaporizing the refrigerant are adapted to inject and vaporize said refrigerant fluid in a limited part of a horizontal section of said cooling cell, in such a manner as to generate in said cooling cell, by siphon effect, a stream of liquid in closed hydraulic circuit, this stream including at least one ascending stream of cold-accumulating and cooling liquid located substantially above said means for injecting the refrigerant and containing bubbles of vaporized refrigerant, and at least one descending stream essentially free of gaseous refrigerant, said means for injecting refrigerant including at least one injector so disposed within said cooling cell as to be surmounted by a vertical column of cold-accumulating and cooling liquid having a height at least sufficient that hydrostatic pressure produced at the injection zone, augmented by aspiration pressure of gaseous refrigerant in said upper portion of said cell, is greater than the saturated vapor pressure of the refrigerant fluid evaluated at the freezing temperature of said cold-accumulating and cooling fluid.

17. Device according to claim 16, wherein said cooling cell includes at least one tubular element constituting a vertical chimney with cylindrical wall surfaces, and wherein said injection means are disposed within said vertical chimney, this chimney being open at its bottom extremity to enable the admission of cold-accumulating and cooling liquid and at its upper extremity to enable discharge of this cooled liquid or of a gel or a suspension composed of this liquid and crystals of this frozen liquid, into the annular space included between this tubular element and the vertical walls of the cooling cell.

18. Device according to claim 17, wherein the section of the tubular element is similar to the section of said annular space.

19. Device according to claim 17, including a single cell d for generating and accumulating said crystals, wherein said section of the tubular element is a fraction of the section of said annular space.

20. Device according to claim 17, wherein said upper extremity of said vertical chimney is disposed above the free level of the cold-accumulating and freezable cooling liquid contained in said cooling cell and said upper extremity is surmounted by a deflector adapted to channel said liquid containing crystals of the frozen liquid in suspension and/or to prevent this liquid from being carried along by the gaseous refrigerant aspirated at the top of said cooling cell by a compressor.

21. Device according to claim 16, wherein said cooling cell and said means for injecting the refrigerant are adapted to maintain the pressure of the cold-accumulating and cooling liquid and of the refrigerant in the vicinity of the injection zone, at a value greater than the vaporization pressure of the refrigerant liquid, evaluated at the freezing temperature of the cold-accumulating and cooling liquid.

22. Device according to claim 21, wherein said means for injecting the refrigerant comprise at least one injector immersed in the bulk of the cold-accumulating and cooling liquid contained in said cell, surmounted by a vertical column of this liquid whose height is at least such that the hydrostatic pressure produced in the injection zone, augmented by the aspiration pressure of the gaseous refrigerant, is greater than the saturated vapor pressure of this refrigerant fluid, evaluated at the freezing temperature of the cold-accumulating and cooling liquid.

23. Device according to claim 22, including said cooling cell and a second cell for accumulating cold, the two cells being interconnected by a circuit designed to convey a mixture of cold-accumulating and cooling liquid and frozen crystals of said liquid, in the form of a gel or a suspension of fluid consistency, wherein said means for injecting said refrigerant are disposed in the lower part of said cooling cell.

24. Device according to claim 21, wherein said injecting means include a chamber connected to an admission for cold-accumulating and cooling liquid under pressure and provided with an outlet opening into said cooling cell, and a nozzle for injecting the refrigerant liquid into said chamber towards said outlet, in such a manner that the jet of refrigerant thus formed is surrounded by a moving sheath of cold-accumulating and cooling liquid which insulates said liquid from the walls of said chamber.

25. Device according to claim 21, including an injection pipe comprising a central tube provided with a series of first orifices, and a coaxial tube provided with a series of second orifices disposed facing said first orifices, said orifices being adapted two by two to form a series of injectors.

* * * * *